US010603671B2

(12) United States Patent
Lietaer

(10) Patent No.: US 10,603,671 B2
(45) Date of Patent: Mar. 31, 2020

(54) DISCHARGE DEVICE FOR SHREDDED ORGANIC MATTER

(71) Applicant: ELIET NV, Otegem (BE)

(72) Inventor: Frederic Lietaer, Otegem (BE)

(73) Assignee: ELIET NV (BE)

( * ) Notice: Subject to any disclaimer, the term of this patent is extended or adjusted under 35 U.S.C. 154(b) by 330 days.

(21) Appl. No.: 15/528,622

(22) PCT Filed: Nov. 23, 2015

(86) PCT No.: PCT/IB2015/059034
§ 371 (c)(1),
(2) Date: May 22, 2017

(87) PCT Pub. No.: WO2016/079723
PCT Pub. Date: May 26, 2016

(65) Prior Publication Data

US 2017/0252750 A1 Sep. 7, 2017

(30) Foreign Application Priority Data

Nov. 21, 2014 (BE) ..... 2014/5081

(51) Int. Cl.
*B02C 18/00* (2006.01)
*B02C 18/22* (2006.01)
*B02C 18/14* (2006.01)

(52) U.S. Cl.
CPC ..... *B02C 18/2216* (2013.01); *B02C 18/145* (2013.01); *B02C 18/22* (2013.01); *B02C 2201/066* (2013.01)

(58) Field of Classification Search
CPC ..... B02C 18/145; B02C 18/2216; B02C 18/2258; B02C 2013/28609; B02C 2013/28654
USPC ..... 241/186.5, 92
See application file for complete search history.

(56) References Cited

U.S. PATENT DOCUMENTS 1,771,163 A * 7/1930 Crites ..... B02C 13/26 241/186.4
4,170,235 A * 10/1979 Ashton ..... A01F 12/10 460/16
4,597,510 A * 7/1986 Durant ..... B65G 65/46 198/669

(Continued)

FOREIGN PATENT DOCUMENTS

DE 3631337 A1 3/1988
DE 2452791 A2 5/2012

(Continued)

OTHER PUBLICATIONS

International Search Report dated Apr. 18, 2016.

*Primary Examiner* — Faye Francis
(74) *Attorney, Agent, or Firm* — Fresh IP PLC; Aubrey Y Chen

(57) ABSTRACT

A discharge device for shredded organic matter from a shredder, wherein the device includes a rotatable shaft on which a fan element is provided which is configured to project the shredded matter in the direction of the discharge side of the discharge device, and displacement apparatuses which are configured to move at least part of the shredded matter in the direction of the fan element. The invention furthermore concerns a shredder provided with such a discharge device.

12 Claims, 3 Drawing Sheets

(56) References Cited

U.S. PATENT DOCUMENTS

| | | | | | |
|---|---|---|---|---|---|
| 5,356,054 | A * | 10/1994 | Loppoli | A01C 3/063 | 222/610 |
| 5,439,182 | A * | 8/1995 | Sgariboldi | A01F 29/005 | 241/260.1 |
| 5,622,323 | A * | 4/1997 | Krueger | A01K 5/002 | 241/101.76 |
| 6,000,649 | A * | 12/1999 | Loppoli | A01F 29/005 | 241/260.1 |
| 6,672,040 | B2 * | 1/2004 | Lauer | A01D 61/008 | 460/71 |
| 7,871,029 | B2 * | 1/2011 | Frey | A01F 29/005 | 241/186.5 |

FOREIGN PATENT DOCUMENTS

| | | | |
|---|---|---|---|
| EP | 1480752 | B1 | 11/2006 |
| FR | 2241235 | A1 | 3/1975 |
| WO | WO2007/086040 | A2 | 8/2007 |

* cited by examiner

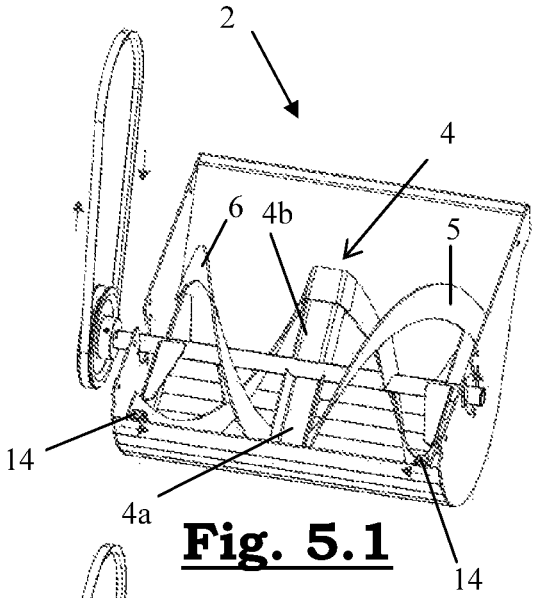
Fig. 5.1
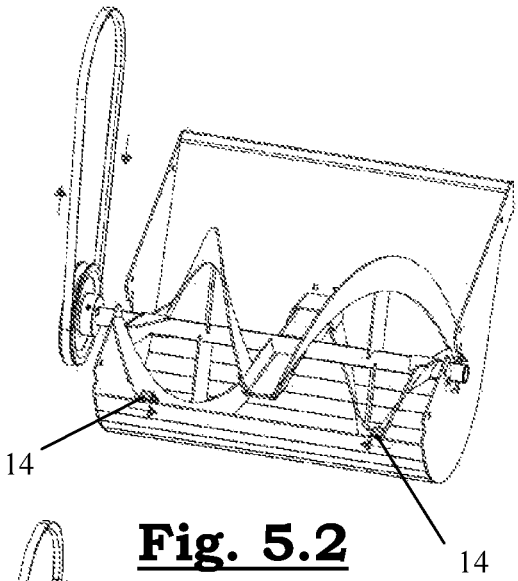
Fig. 5.2
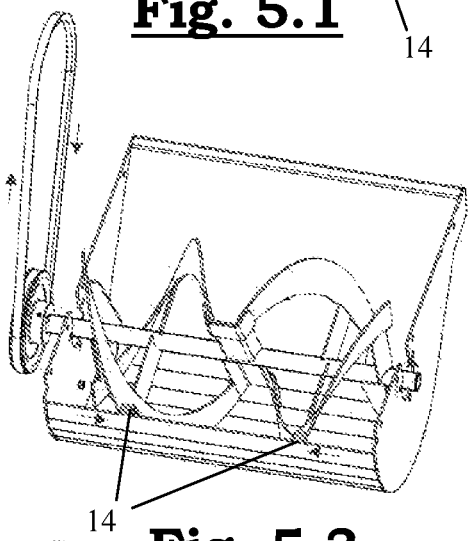
Fig. 5.3
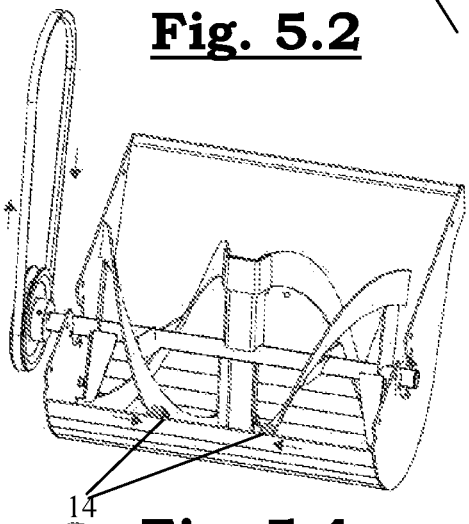
Fig. 5.4
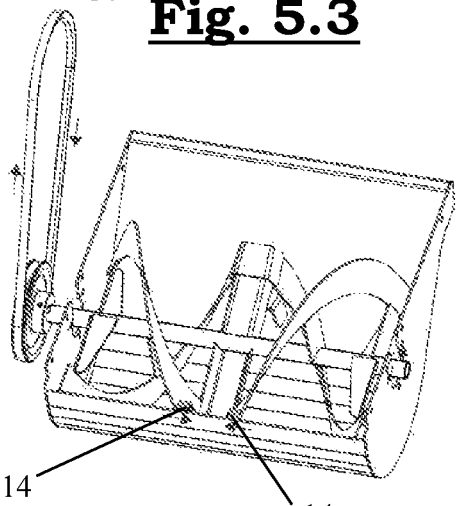
Fig. 5.5
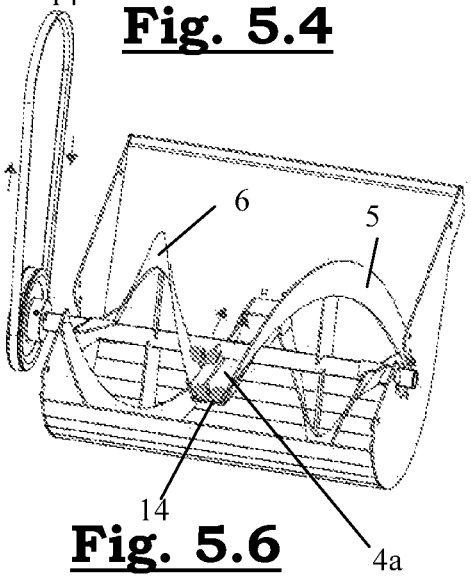
Fig. 5.6

DISCHARGE DEVICE FOR SHREDDED ORGANIC MATTER

This application claims the benefit of Belgian patent applications No. 2014/5081, filed Nov. 21, 2014, which is hereby incorporated by reference in its entirety.

FIELD OF THE INVENTION

This invention concerns firstly a discharge device for shredded organic matter from a shredder, and the invention secondly concerns a shredder for comminuting organic matter into cuttings and provided with such a discharge device. The shredder concerned is preferably a green-waste shredder for shredding garden waste, prunings, flowers, branches, leaves, agricultural crops, foliage etc.

BACKGROUND

Shredders are used for shredding (comminuting, chopping) organic pruning waste such as cuttings, branches, leaves, agricultural crops, foliage etc. and waste from landscaping or farming. Various systems are used for shredding organic matter. After shredding, the cuttings leave the shredding chamber along the discharge side.

A first known system is the disc chopper wherein a plurality of blades is mounted in the surface of a large disc, against which the organic matter is pressed when introduced into an infeed hopper, in some cases via infeed rollers, and chopped transversely between the blades and a counterblade. The chopped matter is then passed towards the back through the opening in the disc. For further discharge, vanes are used which are mounted behind the disc.

A second known system is the drum chopper, wherein a plurality of blades is mounted in the length direction of a drum wall. The organic matter is pressed against the drum wall, whereby said matter is chopped transversely between the blades and a counterblade. In this system, the chopped cuttings fall into a cavity behind the blade, wherein the cuttings are projected out of the cavity via a discharge opening under the effect of the centrifugal force created.

In the abovementioned (first) group of systems, cuttings with fixed dimensions are produced directly as soon as the organic matter comes into contact with the blades.

Such choppers have the disadvantage that they are preferably suitable for shredding branches.

In order to be able to process not only branches but also other waste, such as garden waste, flowers, leaves, agricultural crops, foliage and similar, until today a second group of systems has been used: either hammer or clapper mills wherein the organic matter is comminuted by means of clappers or hammers, or the shredder which is described in European patent EP 1 480 752, which uses an anvil and groups of blades mounted on a shaft and installed rotatably in front of the anvil.

In the second group of systems which are suitable for processing largely green waste, the discharge side of the shredding chamber is provided with a grid with passage openings for the calibration of the cuttings, known as a calibration grating. In this way, only the cuttings which have been chopped sufficiently small by the cutting means can leave the device. In this group, in contrast to the first group, the cuttings are not formed directly. The cuttings are effectively formed in two phases. First a "large" irregular piece is obtained, which is then comminuted to the desired size in the shredding chamber. The calibration grating determines how long the cuttings remain in the shredding chamber. The disadvantage of this system however is that once the cuttings leave the shredder, they fall directly onto the underlying ground under the effect of gravity, whereupon they must then be collected in order to be disposed of. A possible solution to this problem is the placing of a catchment container (sack) of flexible material on the discharge side of the shredding chamber. The fixing of such a sack is however awkward, and in addition the attached container (sack) must then be emptied regularly.

To facilitate the discharge of shredded matter, WO 2007/086040, EP 2 452 791 and DE 36 31 337 describe a number of systems, wherein a suction is created by a fan element which rotates in a separate housing, and wherein displacement means are provided for moving the shredded matter to the centre of the fan element because the suction is strongest there. These systems are often complex. In addition, clogging often occurs because the shredded matter is only discharged under the suction effect created by the fan element. Thus only a limited passage opening is present for the shredded matter, because too large a passage opening would have a negative effect on the pressure build-up.

SUMMARY

This invention now has the object of creating a discharge device for shredded organic matter from a shredder, which ensures that the shredded matter does not fall directly onto the ground after leaving the shredder but allows the shredded matter to be discharged in a simple manner in the direction of a further fitted catchment container.

The object of the invention is achieved by the provision of a discharge device for shredded organic matter from a shredder, comprising a supply and a discharge side, a rotatable shaft on which a fan element is provided which is configured for projecting the shredded matter in the direction of the discharge side, wherein said rotatable shaft furthermore comprises displacement means which are configured to move at least part of the supplied matter in the direction of the fan element, wherein the fan element is positioned centrally on the rotatable shaft and wherein the diameters of the fan element and of the displacement means are the same. By mounting such a discharge device on the discharge side of the shredding chamber of a shredder, the shredded matter does not fall directly onto the ground below the shredder but it is possible to discharge the shredded matter further away from the shredder.

In the device according to the invention, the shredded matter is mainly removed via a projection force which is exerted on the shredded matter by the fan element. Here the displacement means ensure that the shredded matter will be moved in the direction of the fan element. Preferably, the displacement means move the shredded matter to the end of the fan element because the projection force exerted there is the greatest. This movement is supported by the suction force generated by rotation of the fan element. In this way, the device according to the invention discharges the shredded matter much more efficiently, with far less chance of clogging than in the prior art.

In a preferred embodiment of the discharge device according to the invention, the fan element and the displacement means rotate at the same speed. In use, the rotatable shaft of the discharge device rotates at high speed, the rotation speed is preferably at least 1000 rpm, more preferably at last 1500 rpm and more particularly at least 2000 rpm. Due to the high rotation speed of the rotatable shaft and hence also of the fan element, the fan element will firstly generate a suction force which will suck the shredded matter from the shredding chamber of a shredder, and secondly exert a projection force on the shredded matter which comes into contact with the fan element, in order to remove this from the discharge device. The suction force generated will furthermore ensure that the shredded matter (cuttings) moves in the direction of the fan element.

For the discharge, in a preferred embodiment the device comprises a discharge tube along which the cut matter can leave the device. The inlet to the discharge tube is level with the fan element, whereby all the shredded matter coming from the fan element is discharged. The discharge tube is preferably rotatable so that the user can decide in which direction the shredded matter should be discharged.

In a particular embodiment of the discharge device according to the invention, the displacement means comprise a first and a second displacement means, wherein the fan element is provided between the first and second displacement means. The first and second displacement means are preferably formed helical. More particularly, the pitches of the first and second displacement means run opposite to each other. According to a more particular embodiment of the discharge device according to the invention, the thread pitch of the first displacement means runs to the left and the thread pitch of the second displacement means runs to the right. Due to their specific configuration, in use (when rotating), the first and second displacement means will ensure that the shredded matter landing thereon will be moved in the direction of the fan element.

In a more particular embodiment of the discharge device according to the invention, the fan element comprises a first and a second fan part, wherein each fan part comprises a plate-like element. The fan element, just like the displacement means, is made of a wear-resistant material such as e.g. steel. More particularly, the long sides of the plate-like element are designed upright. The fan parts preferably lie in the extension of each other. The first fan part extends from one side of the rotatable shaft, and the other (second) fan part extends from the other side of the rotatable shaft. Both fan parts stand transversely mounted on the rotatable shaft.

The fan parts are preferably concave or spoon-like. Due to the specific shaping of the fan parts, the cuttings are retained better and released under control in the direction of the discharge side. This gives a better flow of matter in the discharge tube. In particular, the abovementioned displacement means are adjacent to the respective fan parts. This ensures an ideal guidance, whereby the shredded matter is removed more quickly.

This invention furthermore relates to a shredder for comminuting organic matter, comprising a shredding chamber with rotatable cutting means for shredding the organic matter, wherein the discharge side of the shredding chamber is provided with a discharge device with a discharge side which comprises a rotatable shaft, on which a fan element is provided which is adapted for projecting shredded matter in the direction of the discharge side, wherein said rotatable shaft furthermore comprises displacement means which are configured to move at least part of the supplied matter in the direction of the fan element, wherein the fan element is positioned centrally on the rotatable shaft and wherein the diameters of the fan element and of the displacement means are the same.

In a preferred embodiment of the shredder according to the invention, the cutting means comprise at least two blade groups mounted next to each other on a shaft and installed rotatably in front of an anvil, wherein said blade groups each comprise a plurality of splitter blades which are intended to split the supplied organic matter mainly following the infeed direction of the matter.

In a particular embodiment of the shredder according to the invention, the splitter blades within one blade group are offset relative to each other on the shaft, so that the projections from their cutting faces onto the anvil do not coincide and cover the entire infeed width.

In a more particular embodiment of the shredder according to the invention, the splitter blades of blade groups mounted adjacent to each other are placed twisted relative to each other so that these act on the supplied organic matter at different moments.

According to a particularly preferred embodiment of the shredder according to the invention, this comprises a discharge device as described above.

BRIEF DESCRIPTION OF THE DRAWINGS

To clarify the properties of this invention further and to illustrate the associated advantages and features thereof, a more detailed description is given below of the shredder according to the invention. It should be clear that nothing in the description below may be interpreted as a restriction of the scope of protection claimed in the claims.

In this description, reference is made by means of reference numerals to the attached drawings in which:

FIG. 5 shows, by means of a number of part FIGS. 5.1 to 5.6, the movement of a cutting through the discharge device according to the invention.

DETAILED DESCRIPTION OF EMBODIMENTS

Figure 1:
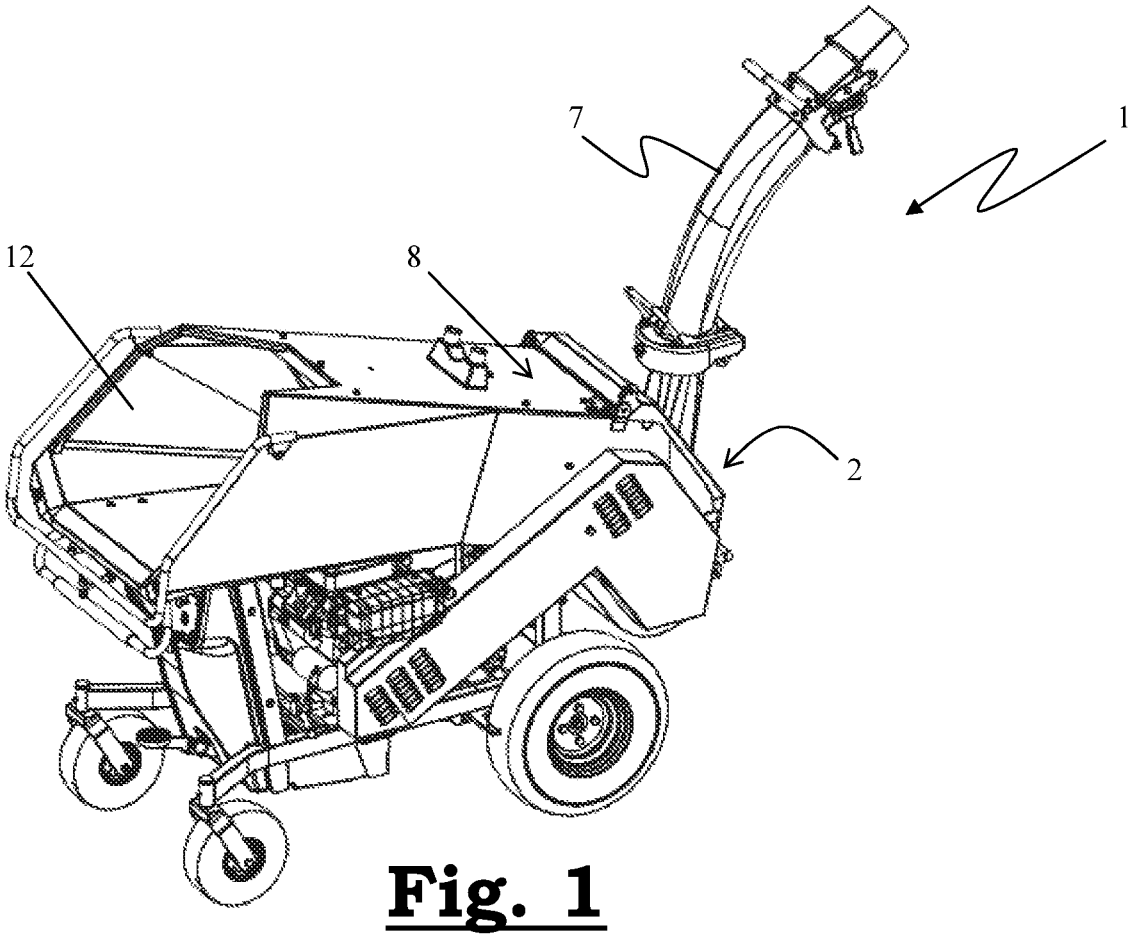
FIG. 1 is a perspective depiction of the shredder according to the invention.
Figure 2:
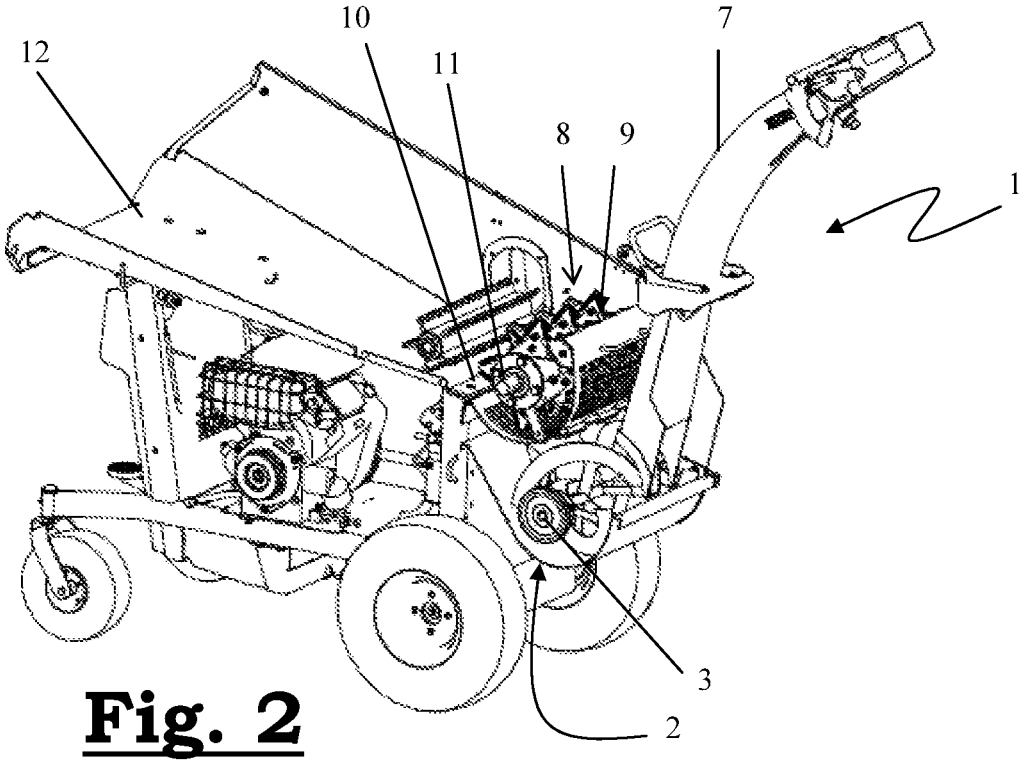
FIG. 2 shows the inside of the shredder shown in FIG. 1.
Figure 3:
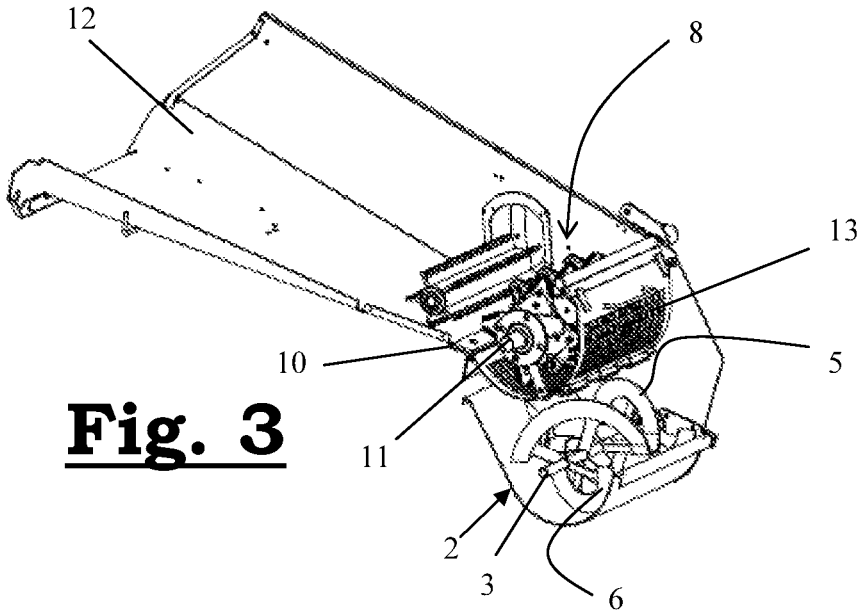
FIG. 3 is a depiction of a detail of a discharge device according to this invention provided at the discharge side of a shredding chamber.

The shredder (1) according to this invention and as shown in FIGS. 1 to 3 comprises a shredding chamber (8) provided with rotatable cutting means (9) for shredding organic matter, and an infeed hopper (12) provided for introducing the organic matter into the shredding chamber (8).

The matter to be shredded is introduced via the infeed opening of the infeed hopper (12), the infeed hopper (12) is connected to the shredding chamber (8) where the supplied matter is then shredded by means of rotatable cutting means (9) into cuttings (14). As soon as the matter to be shredded comes into contact with the cutting means (9), the matter is automatically drawn in by rotation of the cutting means (9).

The cutting means (9), as shown on FIGS. 2 and 3, preferably comprise a rotor mounted transversely to the infeed direction and constructed from a shaft (11) on which at least two adjacent groups of blades are mounted on the periphery and installed rotatably in front of an anvil (10), wherein said blade groups comprise a plurality of fixed splitting blades which are intended to split the supplied matter mainly in the infeed direction of the matter. In a specific embodiment, the blade groups are furthermore provided with at least one chopping blade which is intended to shred the supplied organic matter mainly transversely to the infeed direction of the matter. The rotor rotates in a housing.

The discharge opening (side) of the shredder chamber (8) is provided with a calibration screen (grating) (13), via which the shredded matter is discharged. The calibration screen (13) ensures that the matter remains inside the shredding chamber so that it can be shredded further into smaller particles.

According to the shredder according to the invention, the cuttings (14) are driven through the screen by the cutting means and the created centrifugal force in the direction of a discharge device (2) placed after the cutting chamber (8).

Figure 4:
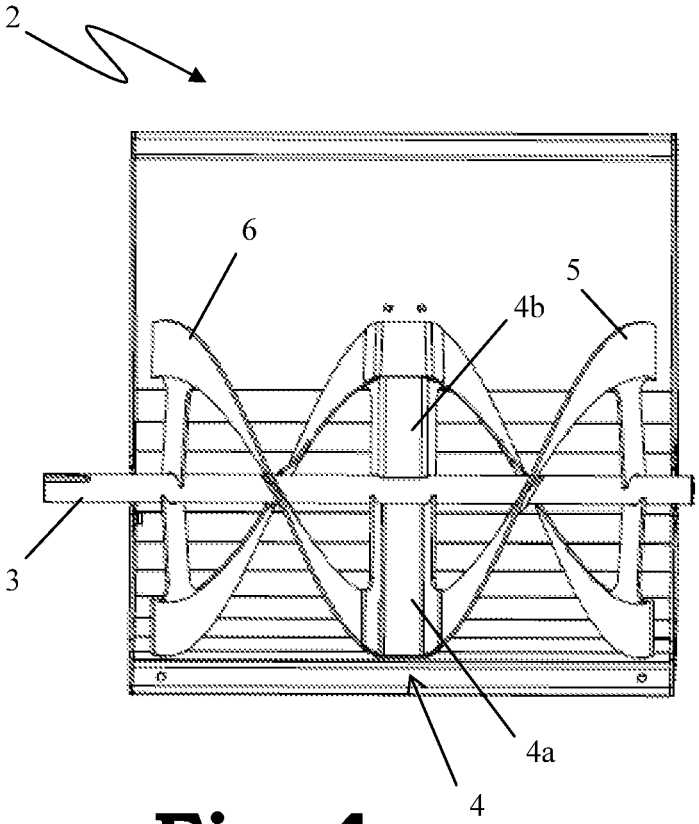
FIG. 4 is a top view of a fan element positioned between a first and a second displacement means.

The discharge device (2) according to this invention, as shown in FIGS. 4 and 5, comprises a rotatable shaft (3) on which a fan element (4) and first (5) and second (6) displacement means are provided. The fan element (4) sits centrally on the shaft concerned, between the first (5) and second (6) displacement means.

The fan element (4) is constructed in two pieces and comprises a first (4*a*) and second (4*b*) fan part which lie in the extension of each other. The first fan part (4*a*) is provided on one side of the rotatable shaft (3), while the other (second) fan part (4*b*) is provided on the other side of the rotatable shaft (3). Both fan parts (4*a* and 4*b*) stand transversely on the rotatable shaft (3). Each fan part (4*a*, 4*b*) is constructed from a flat plate-like element, the long edges of which are designed upright. As shown in FIGS. 4 and 5, the two fan parts (4*a*, 4*b*) are arranged opposite to each other. In this way, the long edges of the first fan part (4*a*) extend in the one direction (e.g. upward) while the long edges of the second fan part (4*b*) extend in the other direction (e.g. downward).

The first and second displacement means are designed helical. Here the pitches of the first (5) and second (6) displacement means run opposite to each other. This is clear from FIG. 4, where the thread pitch of the first displacement means (5) runs to the left and the thread pitch of the second displacement means (6) runs to the right. Due to their specific shaping, in use (when rotating), the first and second displacement means ensure that the shredded matter which lands thereon, or which lies against or in the vicinity of the casing wall of the discharge device (2), will be moved in the direction of the two fan parts (4*a*, 4*b*) of the fan element (4).

This movement of the shredded matter by the displacement means (5, 6) is clarified in FIGS. 5.1 to 5.6, in which we see a possible movement of a cutting (14) which lies in the discharge device (2) according to the invention, on the outside thereof. As the figures show, a cutting lying on the outside (14) (see FIG. 5.1) will, due to the rotation of the displacement means (5 and 6) (see FIGS. 5.2 to 5.5), be transported (moved) towards the centre where it will land on the surface of a fan part (4.1) (see FIG. 5.6). Once it comes into contact with the rotating fan part, it will be projected out of the discharge device (2). In use, the movement of the cuttings towards the fan element (4) is supported by the suction force generated by the fan element (4).

In use, the rotatable shaft (3) of the discharge device (2) will rotate at high speed, wherein the rotation speed is preferably at least 1500 rpm and more particularly at least 2000 rpm. Due to the high rotation speed of the rotatable shaft (3) and hence also of the fan element (4), the fan element (4) will firstly generate a suction force which will suck the shredded matter out of the shredding chamber of a shredder (1) and move it in the direction of the fan element, and secondly exert a projection force on the shredded matter which comes into contact with the fan element (4) in order to remove this from the discharge device (2).

The matter projected by the fan element (4) will leave the discharge device (2) (shredder) via a discharge tube (7). The inlet to the discharge tube (7) lies level with the fan element (4), whereby all the shredded matter coming from the fan element is discharged. The discharge tube is preferably rotatable so that the user can decide in which direction the shredded matter should be discharged. In principle, a catchment container is placed below the outlet from the discharge tube, in which the shredded matter can be captured.

To move the shredder (1) easily, this is provided with a number of wheels, preferably two or four.

The invention claimed is:

1. Shredder for comminuting organic matter, comprising a shredding chamber provided with rotatable cutting means for shredding the organic matter into shredded matter, wherein the shredding chamber comprises an output side from which the shredded matter is removed from the shredding chamber, wherein the output side of the shredding chamber is provided with a discharge device with a discharge side, the discharge device comprising a rotatable shaft on which a fan element is provided, the fan element being adapted for projecting shredded matter that is removed from the shredding chamber in the direction of the discharge side of the discharge device, wherein said rotatable shaft furthermore comprises displacement means which are configured to move at least part of the shredded matter in a direction of the fan element, wherein the fan element is positioned centrally on the rotatable shaft, and wherein the fan element and the displacement means have diameters that are the same.

2. Shredder according to claim 1, characterized in that the cutting means comprises at least two blade groups mounted next to each other on a shaft and installed rotatably in front of an anvil, wherein said blade groups each comprises a plurality of splitter blades which are configured to split the organic matter following infeed of the organic matter into the shredding chamber.

3. Shredder according to claim 2, characterized in that the plurality of splitter blades within one blade group of the at least two blade groups is mounted offset relative to the other blade group of the at least two blade groups on the shaft, such that the plurality of splitter blades within each blade group do not coincide and cover an infeed width of the shredding chamber entirely.

4. Shredder (1) according to claim 2, characterized in that the plurality of splitter blades of any blade groups of the at least two blade groups that are mounted adjacent to each other are placed twisted relative to each other so that each adjacent blade group acts on the organic matter at different moments.

5. Shredder according to claim 1, characterized in that the discharge device comprises a supply side and the discharge side and the rotatable shaft on which the fan element is provided, wherein the fan element and the displacement means rotate at the same speed.

6. Shredder according to claim 1, characterized in that the displacement means comprises a first and a second displacement means, and wherein the fan element is provided between the first and the second displacement means.

7. Shredder according to claim 6, characterized in that each of the first and the second displacement means has a helical shape.

8. Shredder according to claim 7, characterized in that the first and the second displacement means are pitched opposite to each other.

9. Shredder according to claim 1, characterized in that the fan element comprises a first and a second fan part, wherein each fan part comprises a flat element.

10. Shredder according to claim 1, characterized in that the rotatable shaft has a rotation speed of at least 1000 rpm.

11. Shredder according to claim 1, characterized in that the fan element is capable of generating a suction force on the shredded matter.

12. Shredder according to claim 1, characterized in that the discharge device furthermore comprises a discharge tube along which the shredded matter is capable of leaving the discharge device.

* * * * *